US010124385B2

(12) United States Patent
Massaro

(10) Patent No.: US 10,124,385 B2
(45) Date of Patent: Nov. 13, 2018

(54) COUNTER-MATRIX WITH INSERTS FOR METAL PIPES BENDING MACHINES AND BENDING MACHINE WITH SAID COUNTER-MATRIX

(71) Applicant: Libero Angelo Massaro, Piedimonte San Germano (IT)

(72) Inventor: Libero Angelo Massaro, Piedimonte San Germano (IT)

( * ) Notice: Subject to any disclaimer, the term of this patent is extended or adjusted under 35 U.S.C. 154(b) by 381 days.

(21) Appl. No.: 14/650,183

(22) PCT Filed: Dec. 3, 2013

(86) PCT No.: PCT/IB2013/060594
§ 371 (c)(1),
(2) Date: Jun. 5, 2015

(87) PCT Pub. No.: WO2014/087329
PCT Pub. Date: Jun. 12, 2014

(65) Prior Publication Data

US 2015/0314353 A1 Nov. 5, 2015

(30) Foreign Application Priority Data

Dec. 6, 2012 (IT) ..... RM2012A0620

(51) Int. Cl.
*B21D 7/02* (2006.01)
*B21D 7/024* (2006.01)

(52) U.S. Cl.
CPC ..... *B21D 7/02* (2013.01); *B21D 7/024* (2013.01)

(58) Field of Classification Search
CPC ..... B21D 7/02; B21D 7/022; B21D 7/024; B21D 7/03; B21D 7/021; B21D 7/028; B21D 7/04
See application file for complete search history.

(56) References Cited

U.S. PATENT DOCUMENTS 983,664 A * 2/1911 Wilson ..... B21D 7/024 72/150
1,761,798 A * 6/1930 Potter ..... B21D 7/024 72/159
1,794,689 A 3/1931 Holsclaw et al.
(Continued)

FOREIGN PATENT DOCUMENTS

EP 0445081 9/1991
WO 2011/142173 A1 * 11/2011 ..... B21D 7/02

OTHER PUBLICATIONS

International Search Report for PCT/IB2013/060594, Completed by the European Patent Office on Mar. 27, 2014, 3 Pages.

*Primary Examiner* — Edward Tolan
(74) *Attorney, Agent, or Firm* — Brooks Kushman P.C.

(57) ABSTRACT

Counter-matrix having a removable insert at an end and a roller at the other end, wherein the roller, exerting, an annular groove thereof, only the function of guiding the metal pipe being processed and by eliminating any sliding friction with the pipe, reduces the strain of the pipe bending machines. The insert has a semi-cylindrical work surface with a smaller radius or equivalent to the nominal external radius of the pipe. The insert is preferably tilted with respect to the geometric axis of the pipe or metal section, coinciding with the insertion direction of the pipe in the pipe bending machines.

10 Claims, 3 Drawing Sheets

(56) References Cited

U.S. PATENT DOCUMENTS

| | | | | | |
|---|---|---|---|---|---|
| 2,466,381 | A * | 4/1949 | Clouse | B21D 7/024 | 72/158 |
| 2,740,309 | A * | 4/1956 | Martin, Sr. | B21D 3/05 | 72/458 |
| 2,882,953 | A * | 4/1959 | Huet | B21D 7/024 | 72/128 |
| 3,433,042 | A * | 3/1969 | Crihfield | B21D 7/024 | 72/159 |
| 3,613,430 | A * | 10/1971 | Crees | B21F 1/00 | 72/309 |
| 3,949,584 | A * | 4/1976 | Pearson | B21D 7/024 | 72/149 |
| 4,355,528 | A * | 10/1982 | Rothenberger | B21D 7/063 | 72/217 |
| 4,532,787 | A | 8/1985 | Caporusso et al. | | |
| 5,499,521 | A | 3/1996 | Luikart et al. | | |
| 5,694,800 | A * | 12/1997 | Lopez | B21D 7/024 | 72/149 |
| 7,100,414 | B1 * | 9/2006 | Briggs | B21D 7/02 | 72/149 |
| 7,131,306 | B2 * | 11/2006 | Caporusso | B21D 7/063 | 72/149 |
| 7,380,430 | B1 | 6/2008 | Rusch | | |
| 8,857,233 | B2 * | 10/2014 | Nakazato | B21D 7/02 | 72/149 |
| 2005/0210945 | A1 * | 9/2005 | Maier | B21D 7/024 | 72/149 |
| 2006/0112752 | A1 * | 6/2006 | Hu | B21D 7/021 | 72/307 |

* cited by examiner

COUNTER-MATRIX WITH INSERTS FOR METAL PIPES BENDING MACHINES AND BENDING MACHINE WITH SAID COUNTER-MATRIX

CROSS-REFERENCE TO RELATED APPLICATION

This application is the U.S. national phase of PCT Application No. PCT/IB2013/060594 filed on Dec. 3, 2013, which claims priority to IT Patent Application No. RM2012A000620 filed on Dec. 6, 2012, the disclosures of which are incorporated in their entirety by reference herein.

FIELD OF THE ART

The present invention regards an improvement for machines for bending metal pipes (or sections), specifically a particular type of machines for bending metal pipes (or sections). More in detail, the present invention regards a counter-matrix conceived quite differently from the counter-matrices usually used on these machines.

PRIOR ART

Known machines comprise an external casing/body which houses and protects a series of reduction gears. A drive motor, installed within the external casing or body of the machine initially has a very high angular speed of the output shaft thereof which is generally in the order of 1400 revolutions per minute. This speed of rotation is progressively reduced by the reduction gears up to obtaining, on the operating shaft, (the one that provides the torque required for bending the pipe), in a very particular embodiment, a mechanical torque of about 1400-1600 Nm and a number of revolutions per minute of 1.5 up to 3 (about a thousand times lower than the initial value present on the output shaft of the drive motor). Obviously, according to the known formula which provides the power, the product $M \cdot \omega$ would be constant were the losses to be ignored. The number of revolutions and the value of the mechanical torque are purely indicative. They may vary widely (for example even in the order of one or more) even in the machine of the present invention. Generally such values shall be those required for bending a pipe of the desired diameter and thickness. Obviously, such values also depend on the resistance of the material the pipe or section is made of, or other parameters (temperature etcetera).

The operating shaft which provides the power required for bending the metal pipe is made integral to the matrix (substantially a wheel with peripheral groove which receives part of the pipe). The operating shaft projects from the external body of the machine, vertically upwards, perpendicularly to the upper metal plate of the external body, and it for example bears an end with square-shaped head (or hexagonal-shaped head, etc.) to be introduced into a central hole of the matrix, with shape complementary and concentric to the geometric axes of the matrix itself (as well as the operating shaft after mounting). In this manner, the matrix is driven in rotation by the operating shaft. The pipe to be bent is locked on a bracket integral with the matrix (which cooperates with a counter-matrix), and the bracket drives the pipe therealong bending it.

The counter-matrix, in these machines, is for example pushed by an opposing screw so that the pipe is not moved away from the groove.

Other systems for bending pipes are known in the art but they do not regard the present invention. For example, in the so-called "thrust" system the pipe tends to flatten on the external side during the bending given that the drawing of the material cannot be controlled, given the absence of an opposition element like the counter-matrix which "copies" the second half of the pipe (the first is "copied by the matrix").

The function of the counter-matrix of the present invention (same case applying to the other counter-matrices of the prior art) is instead that of reducing the lateral deformations of the pipe, so that it is not flattened on the external side of the bend. The pipe obtained through this process is usually much more rigid in the curving area of the pipe with respect to the straight area of the pipe, given that it has been "denied" of a part of the extension thereof. Thus, the fact that the pipe curving method, by utilizing the matrix and the counter-matrix, is preferred to other alternative methods, such as the thrust technique in which there is substantially just one curving/bending of the material without (or with little) drawing the same, is also due to this reason.

In another method not concerning the present invention there is used a core within the pipe which prevents the pipe from collapsing inwards, maintaining the internal diameter of the pipe substantially unvaried in the critical area immediately after the point of tangency in which the curve starts to form. The internal cores have been made in various forms such as for example adjustable and they are suitably held so as not to be driven therealong by the pipe during the curving, specifically by the great forces involved in the bending process. Otherwise, as mentioned above, in the inherent prior art counter-matrices are used to avoid the flattening of the pipe and the relative reduction of the diameter thereof in the curved part. Specifically, the drawing of the material in the pipe portion (subject to traction of the driving bracket integral with the matrix), which starts bending, causes an inevitable reduction of the diameter of the metal pipe for example by 2-3 mm with respect to the nominal diameter (for example with respect to the initial 50 mm thereof); this implies that the counter-matrix should also gradually reduce the bend radius of the surface of the internal groove thereof, so as to be able to suitably copy and suitably oppose the pipe which is being bent. This was done in the prior art, in which a counter-matrix (patented many years ago) initially has a semi-cylindrical shape which converges into a substantially frustoconical surface or the like, with gradually decreasing diameter (by a few mm). However, the disadvantage of this counter-matrix, made as a long single block made of metal material, extremely hard and anti-friction at the same time, lies in the fact that only the groove-like frustoconical end part of the counter-matrix "operates", while the initial part (semi-cylindrical) of the groove, i.e. the one located most upstream with respect to the insertion direction of the metal pipe in the machine, substantially serves just as a simple guide of the pipe (as well as an opposing element so as to avoid the radial moving away thereof from the matrix) and it is subjected to much lesser wear. In other words, the end part of the counter-matrix wears over time, and thus this implies the need to use an extremely particular material, while the initial part of the matrix (made of the same material that forms the entire block) does not operate but causes friction with the pipe, which increases the stress of the pipe bending machines during the operation for bending the metal pipe. Thus, the disadvantages of this counter-matrix of the prior art lie both in the costs deriving from the periodic replacement of the entire long single block forming the counter-matrix (an expensive piece whose worn part is only the end one) and in the higher stress the pipe bending machines is subjected to due to the friction of the pipe on the initial part of the block.

Thus, the present invention aims at solving these technical problems by providing a counter-matrix that can be used universally in all machines for bending metal pipes/sections, said counter-matrix having a system which allows reducing the stress of the machine and simultaneously suitably countering the unwanted deformations of the metal pipe, and thus avoiding replacing the entire counter-matrix when the "operative" part thereof wears out.

These objects are obtained by providing a counter-matrix for metal pipes bending machines, like the one described in the characterizing part of the main claim (claim 1) of the present patent application.

Some preferred non-limiting variants of the present invention are indicated in the dependent claims.

BRIEF DESCRIPTION OF THE DRAWINGS

The present invention shall now be described with reference to a particular non-limiting and non-binding embodiment of the counter-matrix but only exemplifying and shown in the attached drawings, wherein.

DETAILED DESCRIPTION OF THE PREFERRED EMBODIMENT

In the following detailed description a same detail is indicated in all the figures still using the same reference number, so as to avoid confusion.

Furthermore, though being more detailed than the previous general description of the inventive concept of the present invention, the following description is however limited to the details strictly useful for the understanding of the invention and the applications thereof, without getting into details that are already known or obvious to a man skilled in the art.

Thus, the object of the present detailed description is exclusively that of allowing an average man skilled in the art to understand the attained technical progress, and be able to apply, if willing, the present invention. The specific processes of manufacturing the countermatrix, the specific shape thereof, the materials used, the variability intervals of the various process parameters (mechanical torque required for bending, the speed of rotation of the motor and of the matrix), the details of all means for adjusting the counter-matrix, etc. may be modified or varied at will by the man skilled in the art, without departing from the scope of protection that can be attributed to the present invention.

Figure 1:
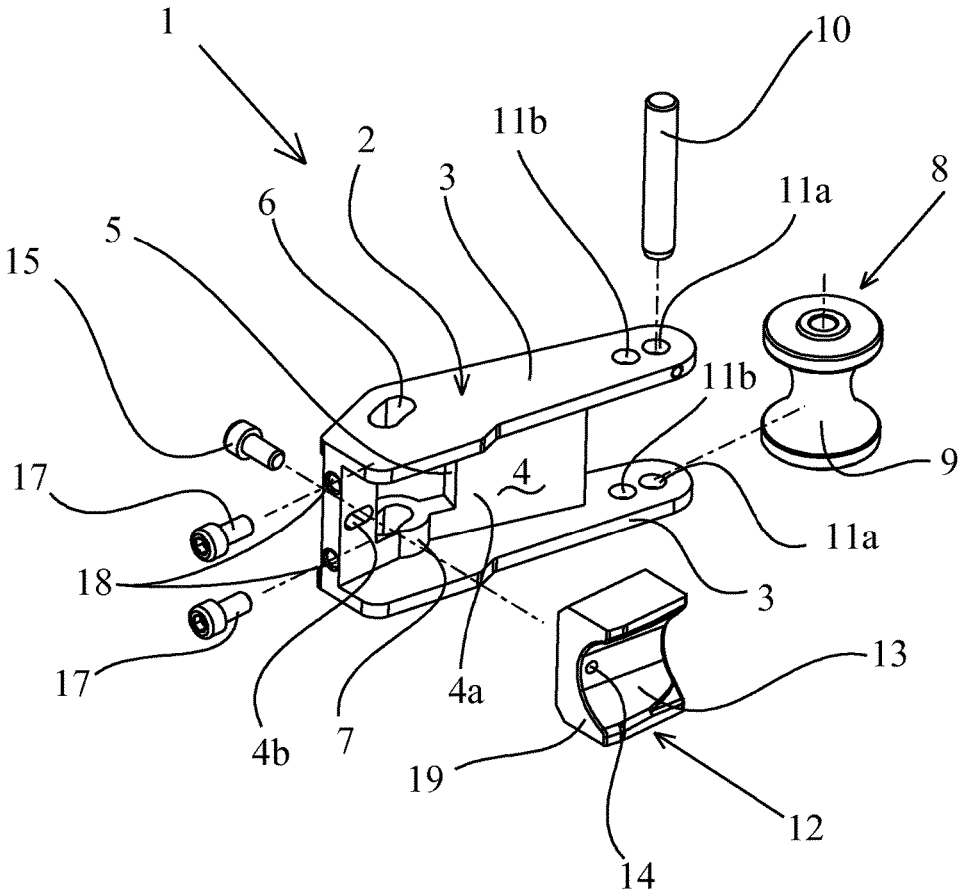
FIG. 1 is an exploded perspective view of the counter-matrix of the present invention.

With reference to FIG. 1, it shows a counter-matrix 1 according to a possible embodiment of the present invention. The counter-matrix 1 has a body 2, formed by a small frame bearing two sides 3 and a central part 4, which connects the two sides 3 between them. The central part 4 is a double tilt, i.e. it has a first wall 4*a* and a second wall 4*b* tilted with respect to the first wall 4*a*. In the converging point between said two walls 4*a*, 4*b* of the body 2 there is provided an opening 5. At the two opposite edges of the opening 5 there is a pair of slots 6 obtained in two respective reinforcement parts 7 of the central part 4. Each part of reinforcement 7 forms a respective stiffening and joining element between a side 3 and the central part 4 of the frame or body 2. The previously described frame or body 2, represents a mounting and support element of at least two fundamental functional components of the counter-matrix 1 of the present invention.

The frame 2 may be obtained for example by melting extremely resistant metal.

The fundamental first component (or insert) is a rolling element, in the present case just a roller 8 having an annular groove 9 which at least partly assumes the external shape of the metal pipe 20 (preferably almost an entire semi-circumference of the pipe 20).

A mounting pin 10 of the roller 8 can be inserted and locked in a first pair of holes (11*a*, 11*a*)—or alternatively in a second pair of holes (11*b*, 11*b*)—and each hole (11*a* or 11*b*) of a pair of holes (11*a*, 11*a* or 11*b*, 11*b*) being close to the corresponding hole (11*b* or 11*a*) of the other pair (11*b*, 11*b* or 11*a*, 11*a*), at the rear end of the respective side 3 of the frame 2. The close pair of holes 11*a* and 11*b* allow adjustment according to the needs of the position of the roller 8 on the body 2.

The second fundamental component of the counter-matrix 1 of the present invention is formed by a small insert 12 having a semi-cylindrical or pre-ovalized groove 13 (but still with constant transverse section in the longitudinal direction different from the aforementioned prior art) with diameter equivalent or lower than the nominal diameter of the metal pipe—or possibly of the section—to be bent, so as to guarantee the minimum ovaling (i.e. reducing the unwanted deformation to the minimum) of the pipe/section being bent. Such insert 12 has a through hole 14 in central position in the semi-cylindrical or pre-ovalized groove 13 thereof, adapted to receive a pin 15 which first traverses a slot 16 obtained on the second wall 4*b*, at the front end of the latter. The pin 15 is preferably a screw (threaded pin) which allows—due to the slot 16—adjusting in various positions and locking (fastening such screw) the insert 12 against the second wall 4*b* of the frame 2 of the counter-matrix 1. However, after performing various tests the inventor realized that it would be preferable not to lock the insert 12 with respect to the body 2 of the counter-matrix 1 at all, in a preferred variant of the present invention. Actually, usually after performing the desired bending on the pipe 20 (or generally on the section), the rotation path of the matrix 21 is inverted and the slot 16 allows the insert 12 to slide backwards on a tilted plane defined by the surface of the wall 4*b*. The effect obtained by the backward displacement of the insert 12 is that of discharging the loads and not affecting the external surface of the pipe 20, thus lastly leading to a perfect quality of the finished product, in particular in case of less hard metals (aluminum etcetera). When the same pipe/section 20 (or another pipe/section 20) is re-introduced for performing another bending operation, it does not require the operator to reposition the insert 12 in the initial advanced position, in that the matrix 21 (once again starting from the initial position thereof) shall drive the pipe 20 (or a new pipe 20) by means of the bracket 22, and the latter shall automatically return (due to the friction) the insert 12 to the advanced operative position of abutment against the heads of the abutment screws 17 (described hereinafter).

With respect to the prior art there are the advantages lying in the fact that:

a) the insert 12 has a mass/inertia much smaller than that of the long single block which used to constitute the conventional matrix, hence it slides backwards much more easily;

b) the insert 12 moves on a tilted plane and thus the friction with the pipe is minimum in the step of displacing the insert (no damage to the pipe).

Alternatively the screw 15 could also be fastened, but against a spacer coaxial to the stem thereof (threaded pin) which in this case would define the maximum depth of fastening thus preventing the insert 12 from reaching a direct locking contact against the tilted wall 4*b*. In this solution, even by completely fastening the screw 15 up to touching—at the head thereof—the spacer (also which traverses the slot 16), the insert 12, not being locked against the wall 4*b* of the body 2, could (as described above) slide with respect to the body 2, thus determining the aforementioned effect.

Alternatively, or in combination with the motion of the insert 12, also the entire body 2 of the counter-matrix 1 could be receded as described in another part of the description, due to the slot 6, still with the aim of obtaining a perfect quality of the pipe 20 upon completing the bending.

In addition, there are provided abutment pins or screws, 17, which can be inserted in respective holes 18 obtained at the front part on the front edge of the second wall 4*b*. Specifically, after fastening the screw 15 (to the desired extent) in the through hole 14 of the insert 12, thus arranging the insert 12 between the sides 3, there follows the fastening (to the desired extent) of the abutment screws 17 up to making them attain abutment (with the heads thereof) against the front face 19 of the insert 12, thus locking it in this direction thus avoiding cutting stress on the screw 15 due to the friction exerted by the pipe/metal section during the bending thereof (see FIG. 2).

The insert 12 could be made of the same metal material—or metal alloy—very hard and anti-friction, which used to form the counter-matrix (long single block) of the prior art.

According to the present invention, as an alternative, the rolling element 8 could also comprise more than just one roller 8, two rollers 8 for example being potentially mounted in series, one next to the other, between the two arms or sides 3 (longer than in FIG. 1) of the frame 2 in this case.

Figure 2:
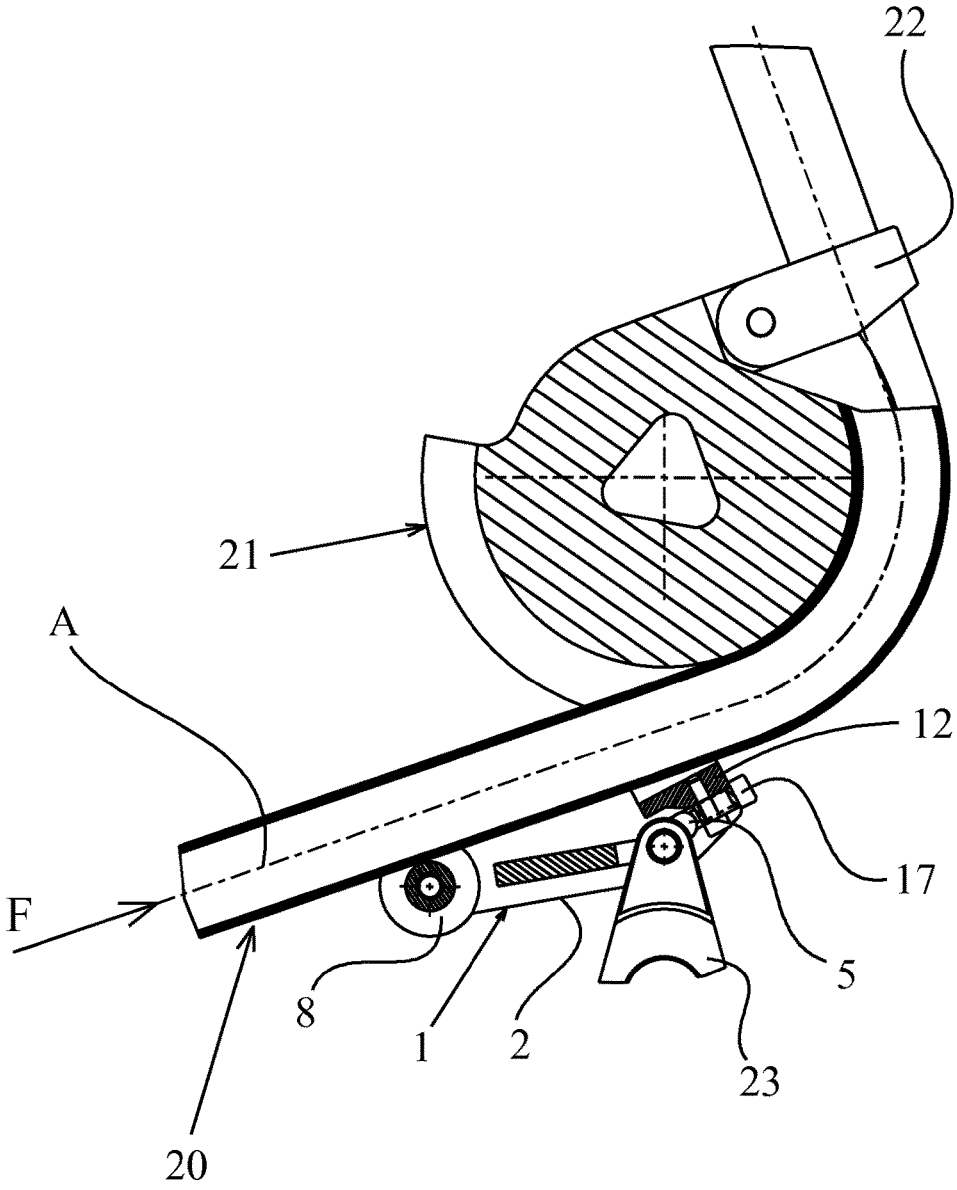
FIG. 2 is a plan and partial sectional view of the pipe bending machines (section executed in the central symmetry plan of the matrix), in which there is shown the operation of the counter-matrix of the present invention.
Figure 3:
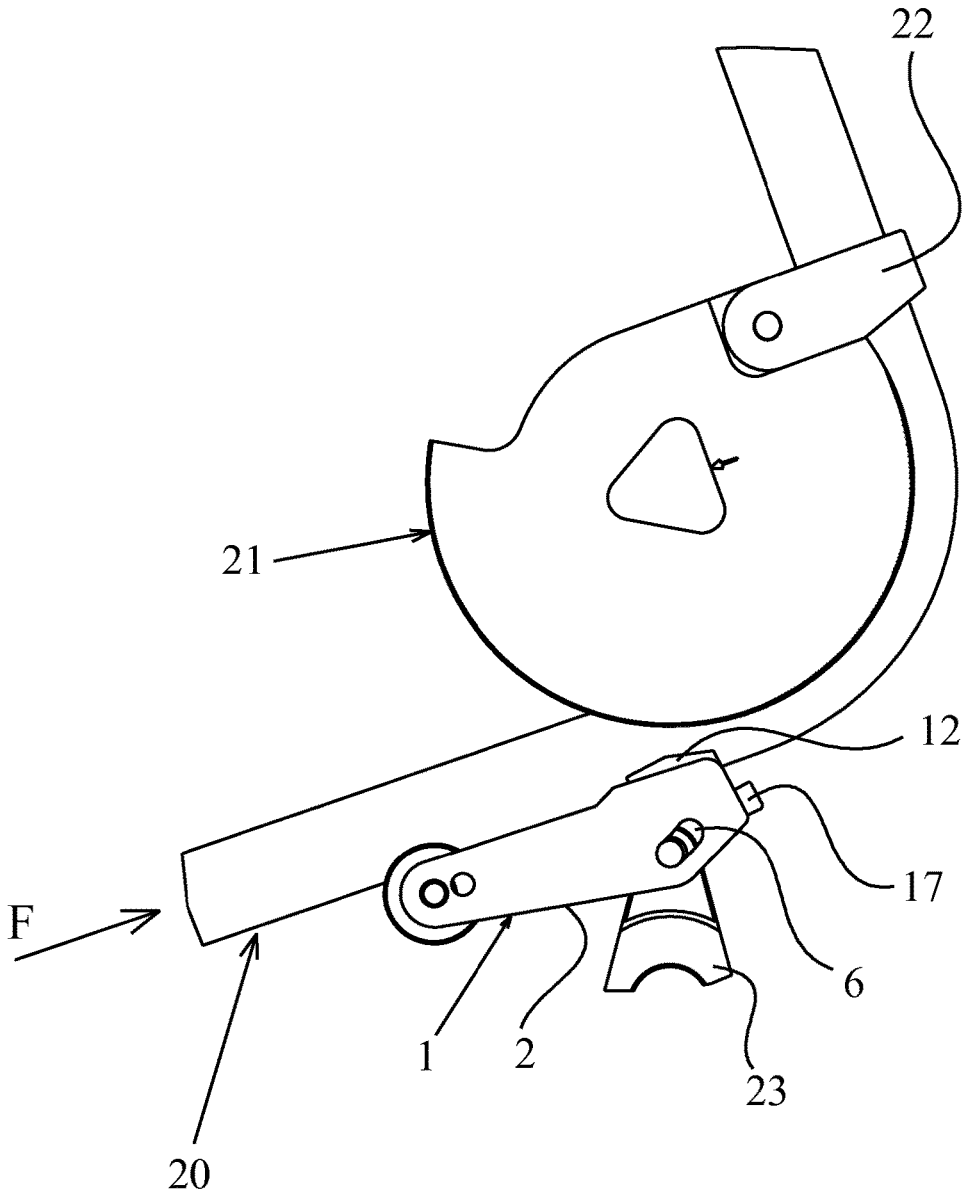
FIG. 3 is a plan view (without section) analogous to FIG. 2.

After describing one from among the possible structures of the counter-matrix 1 according to the present invention, there shall follow the illustration of the operation or effect produced by the counter-matrix 1 during the bending operation i.e. for bending a metal pipe 20 (see FIGS. 2 and 3).

As shown in FIGS. 2 and 3, the metal pipe 20 is inserted in the direction of the arrow F, between the counter-matrix 1 of the invention and the matrix 21 of the pipe bending machines (not represented entirely), the matrix 21 and the counter-matrix 1 of the invention being mounted on the upper horizontal resting plane of the pipe bending machines (also not represented). It should be observed that FIGS. 2 and 3 show the metal pipe 20 when it has already been bent by 90° with respect to the initial shape thereof (which is straight in this section of pipe). Usually, a metal pipe 20 to be installed in a hydraulic system or the like, has—at the end of executing a plurality of bending and counter-bending operations (lying on the same plane or which develop in 3 dimensions)—obtained by introducing the metal pipe 20 several times between the matrix and the counter-matrix of only one pipe bending machine or several machines which bend the pipe 20 either to the right, or, alternatively, to the left, with respect to its direction F of insertion into the pipe bending machines (between the matrix and the counter-matrix).

Regarding this, it should be observed that the Applicant of the present patent application filed a parallel patent application, in which there is described and claimed a machine capable of bending metal pipes (or sections) 20 both to the right and to the left. The present invention (the counter-matrix 1) can also be applied to this type of machine which allows, for the first time (in the method without internal core), bending pipes both to the right and to the left, thus avoiding having to operate on various machines which bend either only to the right, or alternatively, only to the left.

Returning to FIGS. 2 and 3 for describing the operation of the counter-matrix 1 of the invention, the pipe 20 (or the portion of pipe 20 in question) is initially straight and the driving bracket 22 (which is integral in rotation with the matrix 21) is initially at contact with the front part of the counter-matrix 1 (part arranged most downstream with respect to the insertion direction F of the pipe 20). The metal pipe 20 is bent during the rotation of the matrix 21 up to the angular position shown in FIG. 2. The present invention offers the advantage in that in the part in which the pipe simply guided in the straight direction i.e. in the rear part of the counter-matrix 1, the roller 8 solely serves as a rolling guide element and thus the annular groove 9 thereof reduces the friction with the pipe 20 to the minimum. On the other hand, in the prior art, the semi-cylindrical rear part/surface (with respect to the arrow F) of the single long block of the hard anti-friction material which constituted the entire counter-matrix, exerted a sliding friction on the surface of the pipe 20. Thus, considering the same materials, the friction is considerably reduced with respect to the prior art, or the roller 8 may be made of less expensive material than the long single block made of hard anti-friction material the counter-matrix was made up of in the prior art.

Furthermore, the inventor realized that the most and central part of the counter-matrix of the prior art does not serve any function, hence the counter-matrix could be divided into two parts, i.e. in a first rolling insert/element 8 which reduces the friction (located in the rear part), which thus reduces the stress of the pipe bending machines, and in a second insert/operating element 12, which serves to prevent the pipe 20 in the part thereof for drawing the material from flattening freely given that the diameter thereof is smaller and thus would not provide any lateral opposition to prevent the ovaling thereof. Thus, the insert 12 serves the purpose of performing the latter function.

Specifically, the insert 12 has a bend radius (on the semi-cylindrical groove 13 thereof) lesser or at most equivalent to the nominal external radius of the metal pipe 20. Furthermore, in order to obtain an optimal quality for bending the pipe or section 20, the inventor decided to tilt such "forming insert" 12 by a given angle with respect to the central axis "A" of the pipe 20 (FIG. 2), according to the bend radius intended to be obtained and this was obtained (in this embodiment) due to the tilting of the second wall 4*b* with respect to the first wall 4*a* of the body 2 of the counter-matrix 1.

Generally, this allowed obtaining a minimum ovaling of the pipe/section being bent. Also the position of the insert 12 is variable and adjustable according to the bending needs. Regarding this, the previously described adjustment system, i.e. the adjustment screw 15 and the abutment screw 17, can be exploited. The insert 12 shall be made to project by a more or less large degree—with the front face 19 thereof—with respect to the front face of the body 2, for selecting the best action position of the insert 12 with respect to the point of tangency (between pipe 20 and matrix 21) where the pipe 20 starts bending.

The counter-matrix 1 is connected by means of the two slots 6 and a pin (not shown) which traverses the two slots 6, to a support 23 (FIGS. 2 and 3) for allowing the release (opening) at the end of the process for bending the pipe/section 20, by eliminating all the forces generated during the process, thus facilitating the operation of extracting the bent pipe/section. In any case, also the support 23 shall preferably be moveable (by a suitable mechanism such as a toggle lever or a lockable and unlockable hinge system, of the known type).

The bending process may be deemed terminated when the driving bracket 22 is rotated by a desired alpha angle. Such alpha angle can be set, i.e. it can be set at will by the operator by means of an electric control unit of the pipe bending machines, or the pipe bending machine actuation motor may also be stopped manually.

Said alpha angle is the one that still allows, after the elastic return of the bent pipe (so-called "spring-back"), removing the bent pipe from the matrix. Thus, as known to a man skilled in the art, the alpha angle may exceed—and even by far as a function of the used metal—the "intuitive" value of 180°.

An advantage of the invention also consists in the possibility of replacing the insert 12 alone (i.e. the component which processes the piece 20 cooperating with the bracket 22 and the matrix 21) when it wears out. The small dimensions of such component with respect to the single long block of the prior art implies the reduction of costs in terms of higher quality material suitable for processing the pipe 20.

The teachings disclosed by the present invention to the person skilled in the art would easily allow performing modifications on the previously described counter-matrix 1. For example there could be introduced a system for adjusting the tilting of the insert 12 with respect to the axis "A" of the pipe.

The invention claimed is:

1. A machine for bending metal pipes or metal sections, comprising a counter-matrix cooperating with a rotatable matrix, between which the metal pipe is insertable with a geometric axis thereof directed in an insertion direction, said counter-matrix being supported by a support movable and adjustable with respect to the position of a matrix with respect to the position of a point of tangency between a metal pipe and the matrix, said counter-matrix having a part upstream and a part downstream with respect to the insertion direction of the metal pipe, the upstream part acting as a guide of the metal pipe and the downstream part opposing ovaling deformations of the metal pipe, wherein the upstream part of the counter-matrix comprises a rolling guide, acting on an external surface of the metal pipe only by means of rolling friction, and the downstream part of the counter-matrix comprises an insert, separate and spaced from said rolling guide, as well as having an active semi-cylindrical or pre-ovalized surface which is the only surface of the counter-matrix that is in sliding friction contact with the metal pipe and which serves to oppose the ovaling deformations of the metal pipe, and in that an axis of said semi-cylindrical surface of the insert is tilted at a predefined angle, greater than zero, with respect to the geometric axis directed in the insertion direction of the metal pipe.

2. The machine according to claim 1, wherein a bend radius of said active semi-cylindrical or pre-ovalized surface is less than or at most equivalent to a nominal external radius of a metal pipe to be bent and/or the bend radius of said active semi-cylindrical or pre-ovalized surface is less than or at most equivalent to a bend radius of a peripheral groove of the rotatable matrix.

3. The machine according to claim 1, wherein the said rolling guide is adjustable with respect to the insertion direction.

4. The machine according to claim 1, wherein that said rolling guide comprises one or more rollers mounted in a row close to each other and each having an annular groove adapted to a shape of the surface of the metal pipe, at least one of said rollers having a rotation axis thereof substantially parallel to a rotation axis of the rotatable matrix.

5. The machine according to claim 1, wherein the insert is interchangeable.

6. The machine according to claim 1, wherein the insert has an adjustable tilt, enabling the axis of said active semi-cylindrical or pre-ovalized surface of the insert to be tilted by a predefined angle greater than zero with respect to the geometric axis.

7. The machine according to claim 1, wherein the insert of the counter-matrix comprises a very hard, anti-friction material, which is resistant to wear.

8. The machine according to claim 1, wherein the counter-matrix comprises abutment means, acting on a front surface of the insert.

9. The machine according to claim 8, further comprising means for adjusting and locking the insert in position on a body of the counter-matrix, or for mounting the insert in a manner to slide with respect to said body.

10. The machine according to claim 1, wherein the support, movable and adjustable with respect to the position of the matrix, is connected to a body of the counter-matrix by means of a release and opening system, which allows a removal of the body of the counter-matrix from the pipe by eliminating all the forces generated during a process of bending the metal pipe, thus facilitating an operation of extracting the metal pipe.

* * * * *